US011006678B1

(12) United States Patent
Ye

(10) Patent No.: US 11,006,678 B1
(45) Date of Patent: May 18, 2021

(54) NURSING BRA

(71) Applicant: Shenzhen Youyou Bear Technology Co. LTD, Shenzhen (CN)

(72) Inventor: Xiaowei Ye, Shenzhen (CN)

( * ) Notice: Subject to any disclaimer, the term of this patent is extended or adjusted under 35 U.S.C. 154(b) by 0 days.

(21) Appl. No.: 17/083,272

(22) Filed: Oct. 28, 2020

(51) Int. Cl.
*A41C 3/04* (2006.01)
*A41C 3/12* (2006.01)

(52) U.S. Cl.
CPC . *A41C 3/04* (2013.01); *A41C 3/12* (2013.01)

(58) Field of Classification Search
CPC ..... A41C 3/04; A41C 3/12
USPC ..... 450/36
See application file for complete search history.

(56) References Cited

U.S. PATENT DOCUMENTS 3,002,515 A * 10/1961 Glogover ..... A41C 3/04 450/36
10,757,984 B2 * 9/2020 Akerson ..... A41C 3/005
2009/0265831 A1 * 10/2009 Hendrickson ..... A41D 1/215 2/104
2010/0068971 A1 * 3/2010 Hendrickson ..... A41C 3/04 450/31
2010/0068972 A1 * 3/2010 Hendrickson ..... A41C 3/04 450/36
2011/0237156 A1 * 9/2011 Boonen ..... A41C 3/0021 450/36
2011/0314587 A1 * 12/2011 Ritchie ..... A41C 3/04 2/104
2012/0184179 A1 * 7/2012 Blitz ..... A61M 1/062 450/36
2013/0122780 A1 * 5/2013 McCall ..... A41C 3/08 450/30
2014/0295735 A1 * 10/2014 Hagmann ..... A41C 3/12 450/82
2015/0072592 A1 * 3/2015 Van Dooren ..... A41C 3/12 450/86
2015/0351464 A1 * 12/2015 Getter ..... A41C 3/04 450/36
2016/0150834 A1 * 6/2016 Boele ..... A41C 3/0035 450/36

* cited by examiner

*Primary Examiner* — Gloria M Hale
(74) *Attorney, Agent, or Firm* — ZANIP

(57) ABSTRACT

A nursing bra includes a first cover, a second cover, and two back portions. Each cover includes an outer layer and an inner layer. The outer layer includes a first side, a second side opposite to the first side, a third side connected between the first and second sides and a first connection side opposite to the third side. The inner layer includes a fourth side connected with the first side, a fifth side connected with the second side, a sixth side connected between the fourth and fifth sides and a second connection side opposite to the sixth side. A gap is located between the outer layer and the inner layer, a first opening is defined between the third side and the inner layer and communicated with the gap, and a second opening is defined between the second connection side and the outer layer and communicated with the gap.

20 Claims, 8 Drawing Sheets

NURSING BRA

FIELD

The present disclosure relates to bras, and specifically to a nursing bra.

BACKGROUND

Since more and more working nursing mothers need pumping, traditional nursing bras have a big difference from ordinary bras, which can only be worn for pumping milk, but not for nursing or regular wear, so multi-function nursing bras are needed.

BRIEF DESCRIPTION OF THE DRAWINGS

For the purpose of a clearer description of the embodiments in this application or technical solutions in prior art, below is a brief introduction of the attached drawings needed to be used in the description of the embodiments or prior art. Apparently, the attached drawings in the following description are only some embodiments indicated in the present application.

The present disclosure will be further described with reference to the attached drawings and the embodiments hereunder.

DETAILED DESCRIPTION

Figure 1:
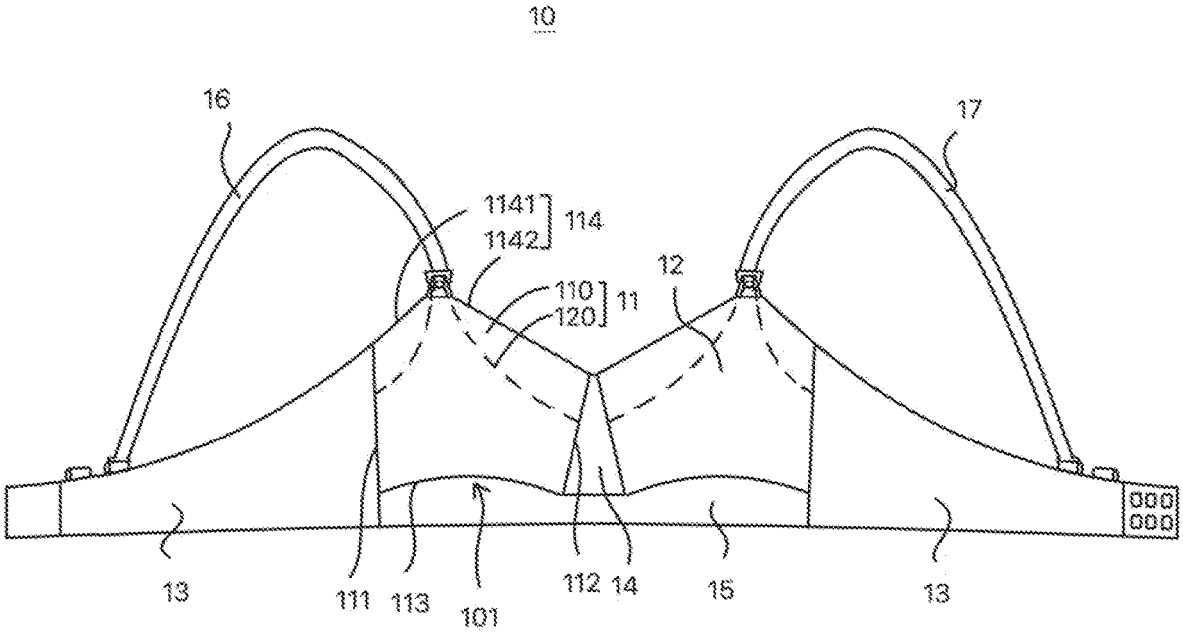
FIG. 1 is a front view of a nursing bra in a first state according to a first embodiment of the present disclosure.

In order to provide a clear understanding of the objects, features, and advantages of the embodiments, the following are detailed and complete descriptions to the technological solutions adopted in the embodiments. Obviously, the descriptions are part of the whole embodiments. It should be noted that non-conflicting embodiments in the disclosure and the features in the embodiments may be combined with each other without conflict.

In the following description, numerous specific details are set forth in order to provide a full understanding of the disclosure. The disclosure may be practiced otherwise than as described herein. The following specific embodiments are not to limit the scope of the disclosure.

Unless defined otherwise, all technical and scientific terms herein have the same meaning as used in the field of the art as generally understood. The terms used in the disclosure are to describe particular embodiments and are not intended to limit the disclosure.

The disclosure, referencing the accompanying drawings, is illustrated by way of examples and not by way of limitation. It should be noted that references to "an" or "one" embodiment in this disclosure are not necessarily to the same embodiment, and such references mean "at least one."

First Embodiment

Referring to FIGS. 1-5, a nursing bra 10 includes a first cover 11, a second cover 12, two back portions 13, a middle portion 14, a base portion 15, a first shoulder strap 16 and a second shoulder strap 17. The first cover 11 is configured to cover a breast of a user. The second cover 12 is configured to cover the other one of the user's two breasts, and the middle portion 14 is connected between the first cover 11 and the second cover 12. One back portion 13 is connected with the first cover 11, the other one back portion 13 is connected with the second cover 12, and the two back portions 13 are configured to connect with each other so as to put the nursing bra 10 on the user. The base portion 15 is connected with the middle portion 14, the first cover 11 and the second cover 12, and the base portion 15 is also connected between the two back portions 13. The first shoulder strap 16 is connected between the first cover 11 and the back portion 13 connected with the first cover 11, and the second shoulder strap 17 is connected between the second cover 12 and the back portion 13 connected with the second cover 12.

Each of the first cover 11 and the second cover 12 includes an outer layer 110 and an inner layer 120 overlapping the outer layer 110. The outer layer 110 includes a first side 111 connected to the back portion 13, a second side 112 opposite to the first side 111, a third side 113 connected between the first side 111 and the second side 112 and a first connection side 114 opposite to the third side 113. The inner layer 120 includes a fourth side 121 connected with the first side 111, a fifth side 122 opposite to the fourth side 121 and connected with the second side 112, a sixth side 123 adjacent to the third side 113 and connected between the fourth side 121 and the fifth side 122 and a second connection side 124 opposite to the sixth side 123. The first side 111 of the first cover 11 is connected with the corresponding back portion 13, and the first side 111 of the second cover 12 is connected with the corresponding back portion 13. The middle portion 14 is connected between the second side 112 of the first cover 11 and the second side 112 of the second cover 12. The base portion 15 is connected with the third side 113 of the first cover 11 and the third side 113 of the second cover 12.

A gap 19 is located between the outer layer 110 and the inner layer 120, a first opening 101 is defined between the third side 113 and the inner layer 120 and communicated with the gap 19, and a second opening 102 is defined between the second connection side 124 and the outer layer 110 and communicated with the gap 19. The third side 113 is configured to be pulled toward the first connection side 114 and the second connection side 124 is configured to be pulled toward the sixth side 123 so as to expose the breast for pumping milk via the first opening 101, the gap 19 and the second opening 102. The outer layer 110 and the inner layer 120 are able to clamp a nursing bottle during pumping such that the user does not need to hold the nursing bottle by hands, thus it is convenient for the user.

Each of the first shoulder strap 16 and the second shoulder strap 17 includes a strap portion 160, a first connection element 161 connected between the second connection side 124 and the strap portion 160, and a second connection element 162 connected between the strap portion 160 and the corresponding back portion 13. The nursing bra 10 further includes a third connection element 18 located at the first connection side 114, the first connection element 161 and the third connection element 18 have a detachable connection.

The first connection element 161 includes a connection portion 1611 connected between the second connection side 124 and the strap portion 160 and a fastener portion 1612 disposed on the connection portion 1611. The third connection element 18 includes a slot 181 corresponding to the fastener portion 1612, and the fastener portion 1612 is configured to be inserted into the slot 181 so as to connect the first connection element 161 and the third connection element 18.

Figure 2:
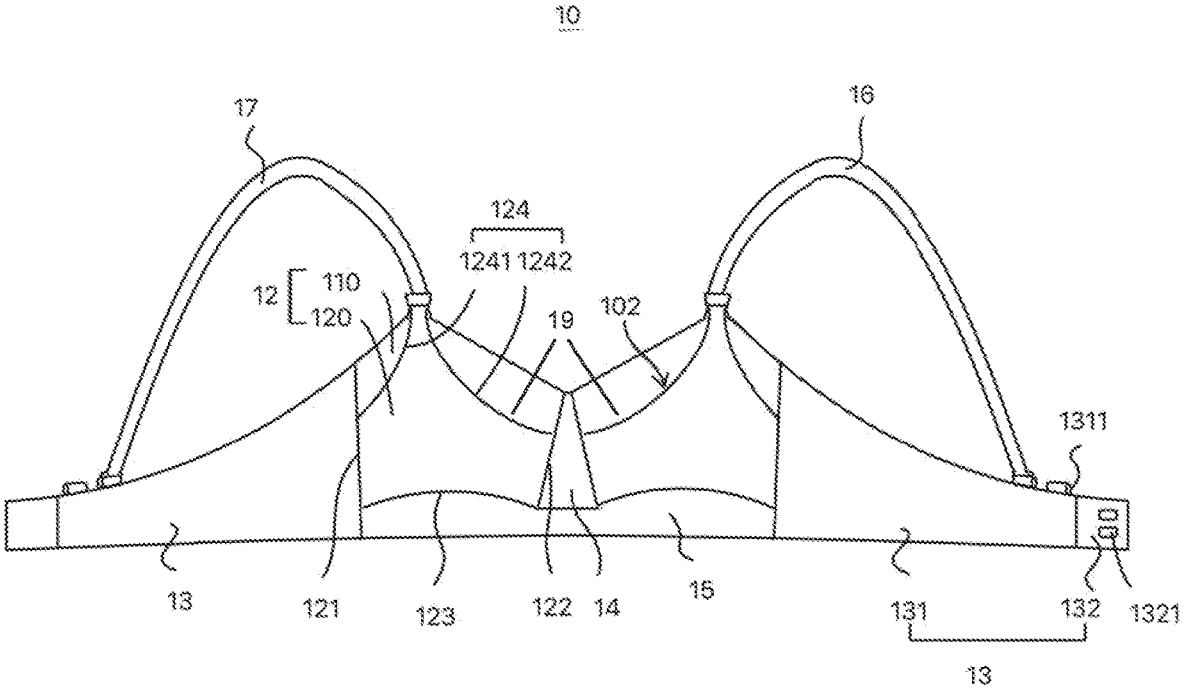
FIG. 2 is a back view of the nursing bra of FIG. 1.
Figure 3:
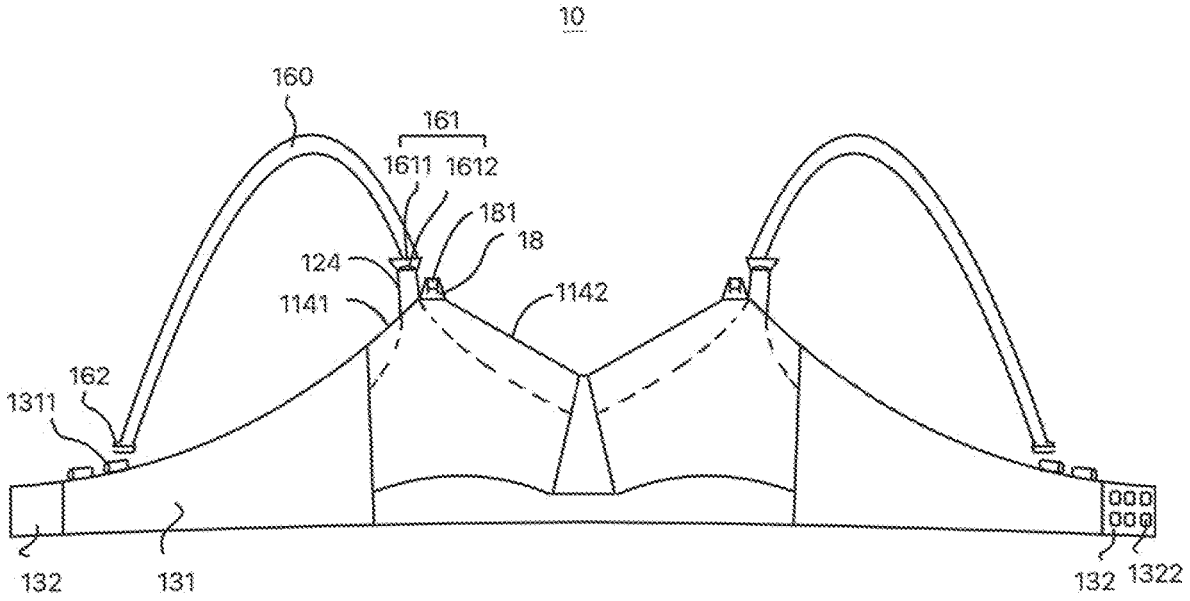
FIG. 3 is a front view of the nursing bra of FIG. 1 in a second state.
Figure 4:
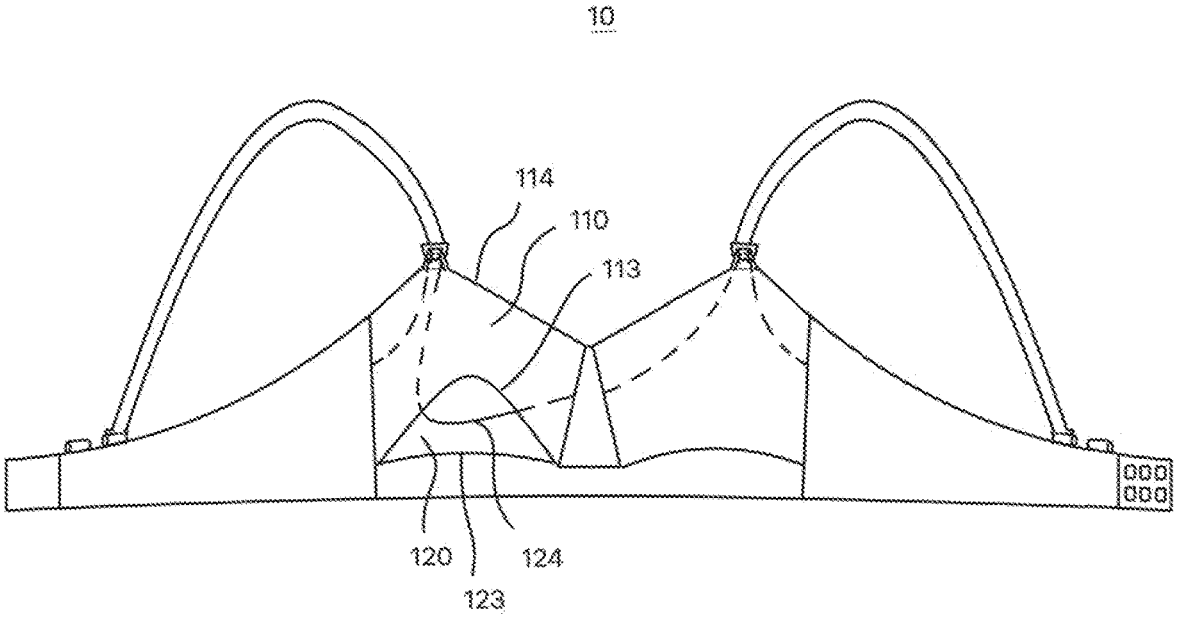
FIG. 4 is a front view of the nursing bra of FIG. 1 in a third state.
Figure 5:
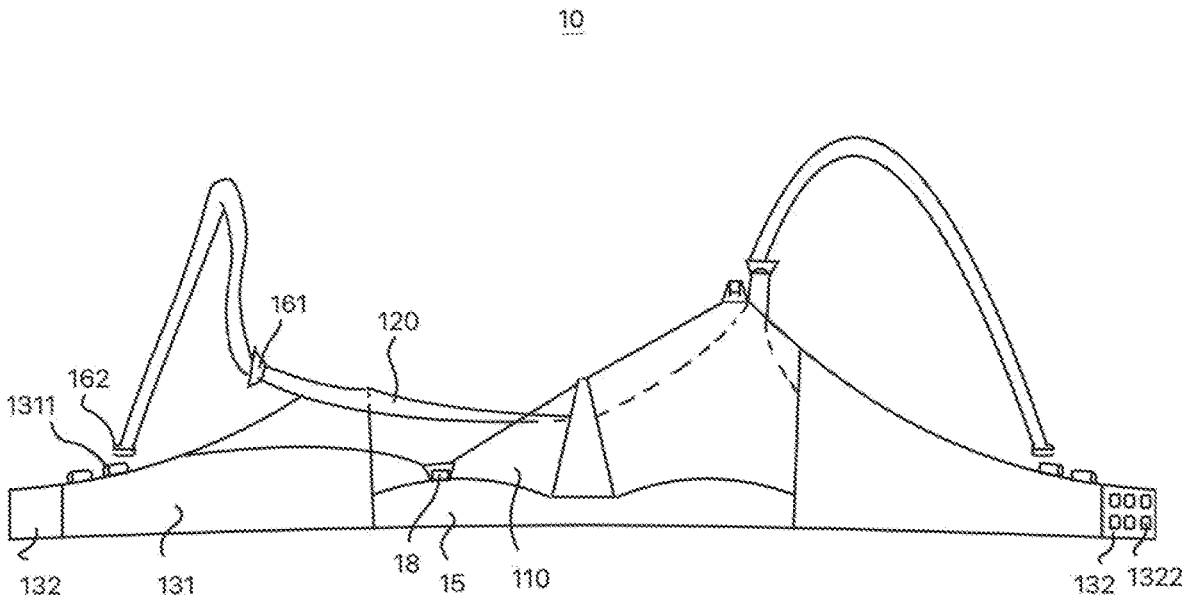
FIG. 5 is a front view of the nursing bra of FIG. 1 in a fourth state.

As shown in FIG. 1 and FIG. 2, in a first state, the fastener portion 1612 inserts into the slot 181, such that the first connection element 161 and the third connection element 18 connect with each other. As shown in FIG. 3, in a second state, the first connection element 161 and the third connection element 18 separate from each other, then it is convenient for exposing the breast via the first opening 101, the gap 19 and the second opening 102. As shown in FIG. 4, in a third state, the third side 113 is pulled toward the first connection side 114 and the second connection side 124 is pulled toward the sixth side 123 so as to expose the breast for feeding a baby or pumping milk via the first opening 101, the gap 19 and the second opening 102. As shown in FIG. 5, in a fourth state, when the third connection element 18 can be detached from the connection element 161, the outer layer 110 can be turned over toward the base portion 15, the inner layer 120 and the corresponding shoulder strap 16 or 17 can be taken off from the breast and the shoulder of the user, such that the breast is exposed for feeding a baby.

The first connection side 114 includes a first sub-side 1141 connected with the first side 111 and a second sub-side 1142 connected between the first sub-side 111 and the second side 112. The second connection side 124 includes a third sub-side 1241 connected with the fourth side 121 and a fourth sub-side 1242 connected between the third sub-side 1241 and the fifth side 122. The first connection element 161 is connected between the third sub-side 1241 and the fourth sub-side 1242, and the third connection element 18 is connected between the first sub-side 1141 and the second sub-side 1142.

The back portion 13 includes a main body 131 connected with one of the first cover 11 and the second cover 12 and a connection end 132 connected with a side of the main body 131. One of the two connection ends 132 of the back portions 13 includes at least one hook portion 1321, and the other one of the two connection ends 132 of the back portions 13 includes at least one ring portion 1322 corresponding to the at least one hook portion 1321. The at least one hook portion 1321 is configured to hook the at least one ring portion 1322 so as to connect the two back portions 13.

The main body 131 includes at least two connection holes 1311 adjacent to the connection end 132, the second connection element 162 is configured to hook one of the at least two connection holes 1311 so as to connect the strap portion 160 and the back portion 13.

It can be understood, the nursing bra 10 can expose the breast of the user via the first opening 101, the gap 19 and the second opening 102, it is convenient for pumping milk from the breast via a breast pump. In addition, the gap 19 can accommodate a nursing bottle connected with the breast pump, the outer layer 110 and the inner layer 120 are able to clamp the nursing bottle during pumping such that the user does not need to hold the nursing bottle by hands, thus it is convenient for the user.

Further, the strap portion 160 and the back portion 13 have a detachable connection via the second connection element 162 and the connection hole 1311, and the first connection element 161 and the second connection side 124 can have a detachable connection, such that the first shoulder strap 17 and the second shoulder strap 16 can be detached from the nursing bra 10 and replaced conveniently. In addition, the second connection element 162 can hook different connection holes 1311 to form different size openings accommodating shoulders of the user, user experience of the nursing bra 10 can be improved. Furthermore, the first connection element 161 and the third connection element 18 can be connected with each other to avoid the inner layer 120 falling off. The third connection element 18 can be detached from the connection element 161, the outer layer 110 can be turned over toward the base portion 15, the inner layer 120 and the corresponding shoulder strap 16 or 17 can be taken off from the breast and the shoulder of the user, such that the breast is exposed for feeding a baby.

Second Embodiment

Figure 6:
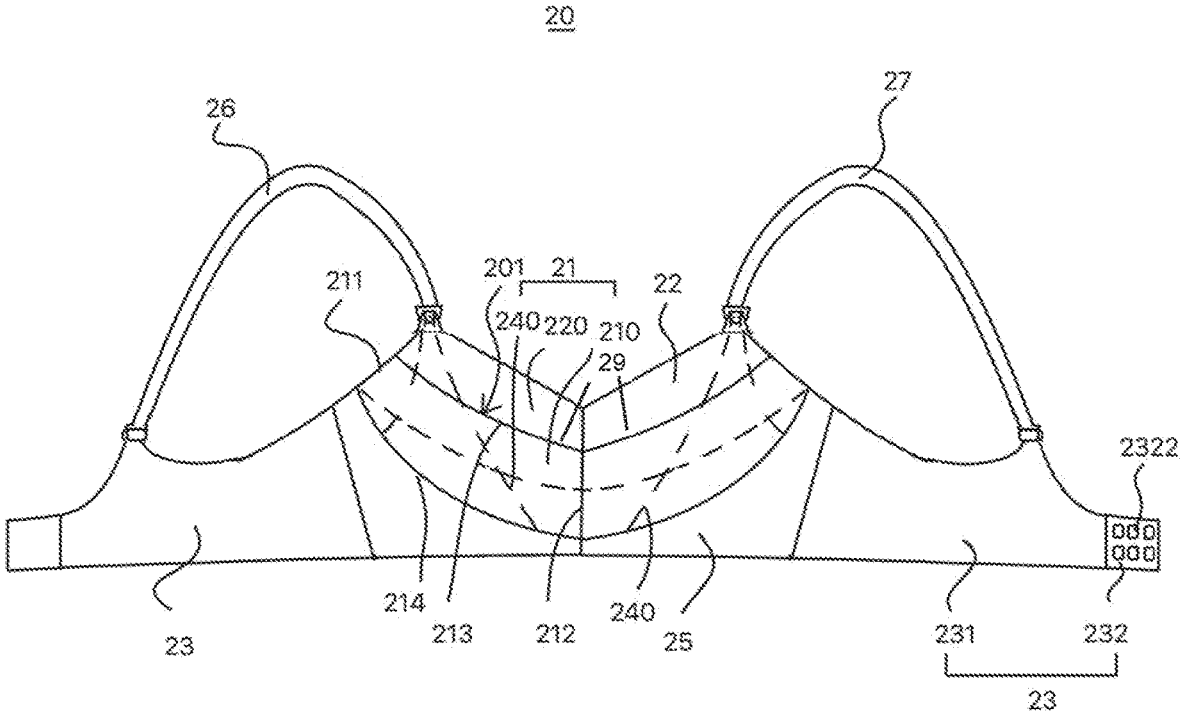
FIG. 6 is a front view of a nursing bra in a first state according to a second embodiment of the present disclosure.
Figure 7:
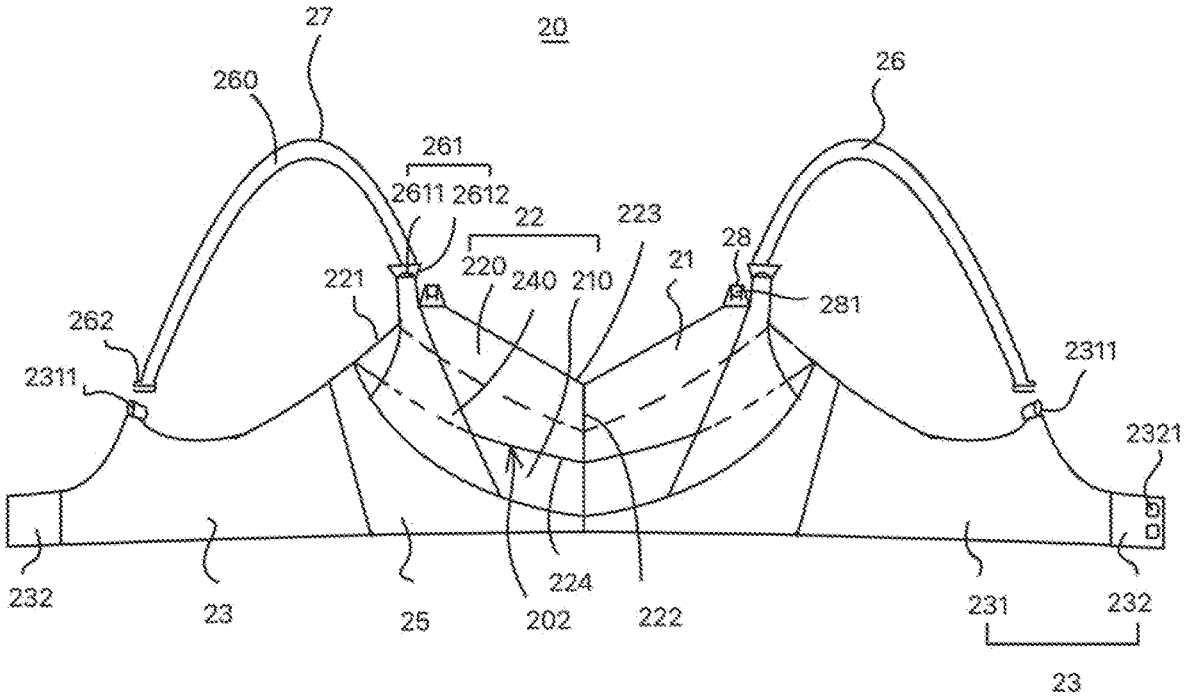
FIG. 7 is a back view of the nursing bra of FIG. 6 in a second state.
Figure 8:
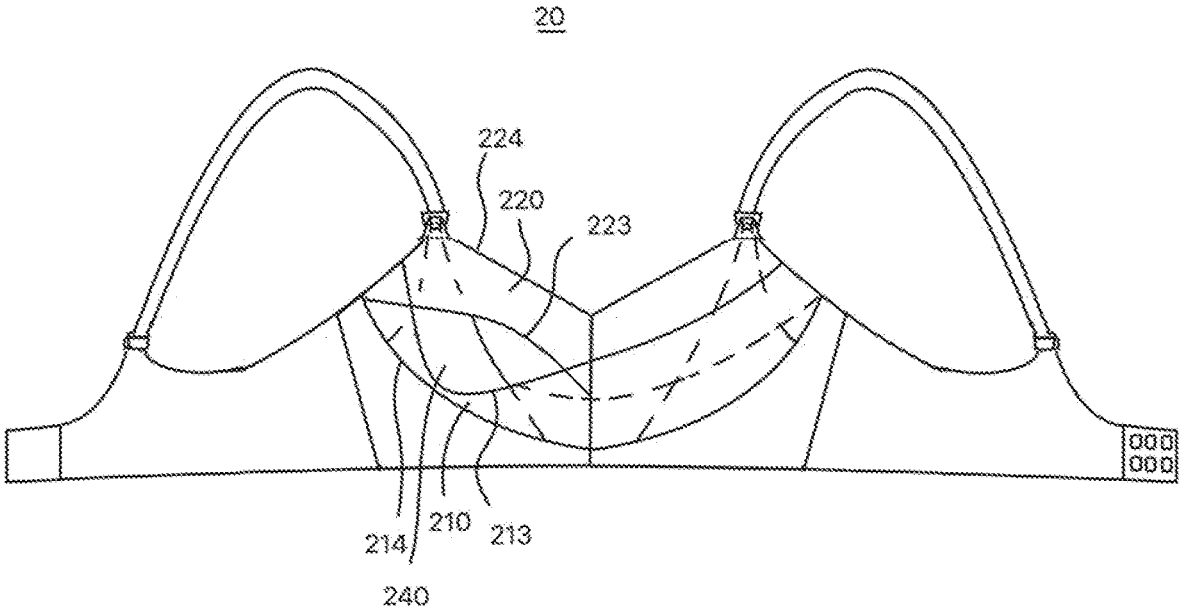
FIG. 8 is a front view of the nursing bra of FIG. 6 in a third state.

Referring to FIGS. 6-8, a nursing bra 20 includes a first cover 21, a second cover 22, two back portions 23, a base portion 25, a first shoulder strap 26 and a second shoulder strap 27. The first cover 21 is configured to cover a breast of a user. The second cover 22 is configured to cover the other one of the user's two breasts, and the second cover 22 is connected with the first cover 21. The base portion 25 is connected with the first cover 21 and the second cover 22, and the base portion 25 is also connected between the two back portions 23, and the two back portions 23 are configured to connect with each other so as to put the nursing bra 20 on the user. The first shoulder strap 26 is connected between the first cover 21 and the corresponding back portion 23, and the second shoulder strap 27 is connected between the second cover 22 and the corresponding back portion 23.

Each of the first cover 21 and the second cover 22 includes an outer layer 210, an inner layer 220 overlapping the outer layer 210 and an auxiliary layer 240 overlapping the inner layer 220. The outer layer 210 includes a first side 211, a second side 212 opposite to the first side 211, a third side 213 connected between the first side 211 and the second side 212 and a first connection side 214 opposite to the third side 213. The inner layer 220 includes a fourth side 221 connected with the first side 211, a fifth side 222 opposite to the fourth side 221 and connected with the second side 212, a sixth side 223 connected between the fourth side 221 and the fifth side 222 and a second connection side 224 opposite to the sixth side 223. The second side 212 of the first cover 21 can be connected with the second side 212 of the second 22 cover by sewing threads.

A gap 29 is located between the outer layer 210 and the inner layer 220, a first opening 201 is defined between the third side 213 and the inner layer 220 and communicated with the gap 29, and a second opening 202 is defined between the second connection side 224 and the outer layer 210 and communicated with the gap 29. The third side 213 is configured to be pulled toward the first connection side 214 and the second connection side 224 is configured to be pulled toward the sixth side 223 so as to expose the breast for feeding a baby via the first opening 201, the gap 29 and the second opening 202. The outer layer 210 and the inner layer 220 are able to clamp a nursing bottle during pumping such that the user does not need to hold the nursing bottle by hands, thus it is convenient for the user.

The auxiliary layer 240 of the first cover 21 is connected between the first connection side 214 of the first cover 21 and the first shoulder strap 26, and the first shoulder strap 26 is connected between the auxiliary layer 240 of the first cover 21 and the corresponding back portion 23. The auxiliary layer 240 of the second cover 22 is connected between the first connection side 214 of the second cover 22 and the second shoulder strap 27, and the second shoulder strap 27 is connected between the auxiliary layer 240 of the second cover 22 and the corresponding back portion 23.

Each of the first shoulder strap 26 and the second shoulder strap 27 includes a strap portion 260, a first connection element 261 connected between the auxiliary layer 240 and the strap portion 260, and a second connection element 262 connected between the strap portion 260 and the corresponding back portion 23. The nursing bra 20 further includes a third connection element 28 located between the second connection side 224 and the fourth side 221, and the first connection element 261 and the third connection element 28 have a detachable connection.

The first connection element 261 includes a connection portion 2611 connected between the auxiliary layer 240 and the strap portion 260 and a fastener portion 2612 disposed on the connection portion 2611. The third connection element 28 includes a slot 281 corresponding to the fastener portion 2612, the fastener portion 2612 is configured to be inserted into the slot 281 so as to connect the first connection element 261 and the third connection element 28.

As shown in FIG. 6, in a first state, the fastener portion 2612 inserts into the slot 281, such that the first connection element 261 and the third connection element 28 connect with each other. As shown in FIG. 7, in a second state, the first connection element 261 and the third connection element 28 separate from each other, then it is convenient for exposing the breast via the first opening 201, the gap 29 and the second opening 202. As shown in FIG. 8, in a third state, the third side 213 is pulled toward the first connection side 214 and the second connection side 224 is pulled toward the sixth side 223 so as to expose the breast for feeding a baby or pumping milk via the first opening 201, the gap 29 and the second opening 202.

When the third connection element 28 can be detached from the connection element 261, the outer layer 210 can be turned over toward the base portion 25, the inner layer 220 and the corresponding shoulder strap 26 or 27 can be taken off from the breast and the shoulder of the user, such that the breast is exposed for feeding a baby.

The back portion 23 includes a main body 231 connected with one of the first cover 21 and the second cover 22 and a connection end 232 connected with a side of the main body 231. One of the two connection ends 232 of the back portions 23 includes at least one hook portion 2321, and the other one of the two connection ends 232 of the back portions includes at least one ring portion 2322 corresponding to the hook portion 2321, and the hook portion 2321 is configured to hook the ring portion 2322 so as to connect the two back portions 23.

The main body 231 includes a connection hole 2311 adjacent to the connection end 232, the second connection element 262 is configured to hook one of the connection hole 2311 so as to connect the strap portion 260 and the back portion 23.

It can be understood, the nursing bra 20 can expose the breast of the user via the first opening 201, the gap 29 and the second opening 202, it is convenient for feeding a baby or pumping milk from the breast via a breast pump. In addition, the gap 29 can accommodate a nursing bottle connected with the breast pump, the outer layer 210 and the inner layer 220 are able to clamp the nursing bottle during pumping such that the user does not need to hold the nursing bottle by hands, thus it is convenient for the user.

Further, the strap portion 260 and the back portion 23 have a detachable connection via the second connection element 262 and the connection hole 2311, and the first connection element 261 and the second connection side 224 can have a detachable connection, such that the first shoulder strap 26 and the second shoulder strap 27 can be detached from the nursing bra and replaced conveniently. In addition, the first connection element 261 and the third connection element 28 can be connected with each other to avoid the auxiliary layer 240 falling off. The third connection element 28 can be detached from the connection element 261, the outer layer 210 can be turned over toward the base portion 25, the inner layer 220 and the corresponding shoulder strap 26 or 27 can be taken off from the breast and the shoulder of the user, such that the breast is exposed for feeding a baby.

Finally, it should be noted that above embodiments are merely used for illustrating the technical solutions of the disclosure, rather than limiting the disclosure; though the disclosure is illustrated in detail with reference to the aforementioned embodiments, it should be understood by those of ordinary skill in the art that modifications may still be made on the technical solutions disclosed in the aforementioned respective embodiments, or equivalent substitutions may be made to a part of technical features thereof; and these modifications or substitutions do not make the essence of the corresponding technical solutions depart from the spirit and scope of the technical solutions of the respective embodiments of the disclosure.

What is claimed is:

1. A nursing bra, comprising a first cover configured to cover a breast of a user, a second cover connected to the first cover and configured to cover the other one of the user's two breasts, and two back portions, one back portion connected with the first cover, the other one back portion connected with the second cover, the two back portions configured to connect with each other so as to put the nursing bra on the user, wherein each of the first cover and the second cover comprises an outer layer and an inner layer overlapping the outer layer, the outer layer comprises a first side connected to the back portion, a second side opposite to the first side, a third side connected between the first side and the second side and a first connection side opposite to the third side, the inner layer comprises a fourth side connected with the first side, a fifth side opposite to the fourth side and connected with the second side, a sixth side connected between the fourth side and the fifth side and a second connection side opposite to the sixth side, a gap is located between the outer layer and the inner layer, a first opening is defined between the third side and the inner layer and communicated with the gap, a second opening is defined between the second connection side and the outer layer and communicated with the gap, the third side is configured to be pulled toward the first connection side and the second connection side is configured to be pulled toward the sixth side so as to expose the breast via the first opening, the gap and the second opening, and the outer layer and the inner layer are configured to clamp a nursing bottle during pumping.

2. The nursing bra according to claim 1, wherein the nursing bra further comprises a middle portion and a base portion, the middle portion is connected between the first cover and the second cover, the base portion is connected with the middle portion and the sixth sides of the inner layers of the first cover and the second cover, and the base portion is also connected between the two back portions.

3. The nursing bra according to claim 1, wherein the nursing bra further comprises a first shoulder strap and a second shoulder strap, the first shoulder strap is connected between the second connection side of the inner layer of the first cover and the back portion connected with the first cover, and the second shoulder strap is connected between the second connection side of the inner layer of the second cover and the back portion connected with the second cover.

4. The nursing bra according to claim 3, wherein each of the first shoulder strap and the second shoulder strap comprises a strap portion, a first connection element connected between the second connection side and the strap portion, and a second connection element connected between the strap portion and the corresponding back portion, the nursing bra further comprises a third connection element located at the first connection side, the first connection element and the third connection element have a detachable connection, and the first connection element and the second connection side have a detachable connection.

5. The nursing bra according to claim 4, wherein the first connection element comprises a connection portion connected between the second connection side and the strap portion and a fastener portion disposed on the connection portion, the third connection element comprises a slot corresponding to the fastener portion, and the fastener portion is configured to be inserted into the slot so as to connect the first connection element and the third connection element.

6. The nursing bra according to claim 4, wherein the back portion comprises a main body connected with one of the first cover and the second cover and a connection end connected with a side of the main body, one of the two connection ends of the back portions comprises at least one hook portion, and the other one of the two connection ends of the back portions comprises at least one ring portion corresponding to the at least one hook portion, and the at least one hook portion is configured to hook the at least one ring portion so as to connect the two back portions.

7. The nursing bra according to claim 6, wherein the main body comprises at least two connection holes adjacent to the connection end, the second connection element is configured to hook one of the at least two connection holes so as to connect the strap portion and the back portion.

8. The nursing bra according to claim 1, wherein the nursing bra further comprises a base portion, the base portion is connected with the first connection sides of the outer layers of the first cover and the second cover, and the base portion is also connected between the two back portions.

9. The nursing bra according to claim 8, wherein each of the first cover and the second cover comprises an auxiliary layer, the nursing bra further comprises a first shoulder strap and a second shoulder strap, the auxiliary layer of the first cover is connected between the first connection side of the first cover and the first shoulder strap, and the first shoulder strap is connected between the auxiliary layer of the first cover and the corresponding back portion, the auxiliary layer of the second cover is connected between the first connection side of the second cover and the second shoulder strap, and the second shoulder strap is connected between the auxiliary layer of the second cover and the corresponding back portion.

10. The nursing bra according to claim 9, wherein each of the first shoulder strap and the second shoulder strap comprises a strap portion, a first connection element connected between the auxiliary layer and the strap portion, and a second connection element connected between the strap portion and the corresponding back portion, the nursing bra further comprises a third connection element located between the second connection side and the fourth side, the first connection element and the third connection element have a detachable connection.

11. The nursing bra according to claim 10, wherein the first connection element comprises a connection portion connected between the auxiliary layer and the strap portion and a fastener portion disposed on the connection portion, the third connection element comprises a slot corresponding to the fastener portion, the fastener portion is configured to be inserted into the slot so as to connect the first connection element and the third connection element.

12. The nursing bra according to claim 10, wherein the back portion comprises a main body connected with one of the first cover and the second cover and a connection end connected with a side of the main body, one of the two connection ends of the back portions comprises at least one hook portion, the other one of the two connection ends of the back portions comprises at least one ring portion corresponding to the hook portion, and the hook portion is configured to hook the ring portion so as to connect the two back portions.

13. The nursing bra according to claim 12, wherein the main body comprises a connection hole adjacent to the connection end, the second connection element is configured to hook the connection hole so as to connect the strap portion and the back portion.

14. A nursing bra, comprising a first cover configured to cover a breast of a user, a second cover connected to the first cover and configured to cover the other one of the user's two breasts, and two back portions, one back portion connected with the first cover, the other one back portion connected with the second cover, the two back portions configured to connect with each other so as to put the nursing bra on the user, a first shoulder strap connected between the first cover and the corresponding back portion, and a second shoulder strap connected between the second cover and corresponding back portion, wherein each of the first cover and the second cover comprises an outer layer and an inner layer overlapping the outer layer, the outer layer comprises a first side connected to the back portion, a second side opposite to the first side, a third side connected between the first side and the second side and a first connection side opposite to the third side, the inner layer comprises a fourth side connected with the first side, a fifth side opposite to the fourth side and connected with the second side, a sixth side connected between the fourth side and the fifth side and a second connection side opposite to the sixth side, a gap is located between the outer layer and the inner layer, a first opening is defined between the third side and the inner layer and communicated with the gap, a second opening is defined between the second connection side and the outer layer and communicated with the gap, the third side is configured to be pulled toward the first connection side and the second connection side is configured to be pulled toward the sixth side so as to expose the breast via the first opening, the gap and the second opening, and the outer layer and the inner layer are configured to clamp a nursing bottle during pumping.

15. The nursing bra according to claim 14, wherein the nursing bra further comprises a middle portion and a base portion, the middle portion is connected between the first cover and the second cover, the base portion is connected with the middle portion and the sixth sides of the inner layers of the first cover and the second cover, and the base portion is also connected between the two back portions.

16. The nursing bra according to claim 15, wherein each of the first shoulder strap and the second shoulder strap comprises a strap portion, a first connection element connected between the second connection side and the strap portion, and a second connection element connected between the strap portion and the corresponding back portion, the nursing bra further comprises a third connection element located at the first connection side, the first connection element and the third connection element have a detachable connection, and the first connection element and the second connection side have a detachable connection; wherein the first connection side comprises a first sub-side connected with the first side and a second sub-side connected between the first sub-side and the second side, the second connection side comprises a third sub-side connected with the fourth side and a fourth sub-side connected between the third sub-side and the fifth side, the first connection element is connected between the third sub-side and the fourth sub-side, and the third connection element is connected between the first sub-side and the second sub-side.

17. The nursing bra according to claim 16, wherein the first connection element comprises a connection portion connected between the second connection side and the strap portion and a fastener portion disposed on the connection portion, the third connection element comprises a slot corresponding to the fastener portion, the fastener portion is configured to be inserted into the slot so as to connect the first connection element and the third connection element, the back portion comprises a main body connected with one of the first cover and the second cover and a connection end connected with a side of the main body, one of the two connection ends of the back portions comprises at least one hook portion, the other one of the two connection ends of the back portions comprises at least one ring portion corresponding to the hook portion, and the hook portion is configured to hook the ring portion so as to connect the two back portions.

18. The nursing bra according to claim 14, wherein the second side of the first cover is connected with the second side of the second cover by sewing threads, the nursing bra further comprises a base portion, the base portion is connected with the first connection sides of the outer layers of the first cover and the second cover, and the base portion is also connected between the two back portions.

19. The nursing bra according to claim 18, wherein each of the first cover and the second cover comprises an auxiliary layer, the auxiliary layer of the first cover is connected between the first connection side of the first cover and the first shoulder strap, and the first shoulder strap is connected between the auxiliary layer of the first cover and the corresponding back portion, the auxiliary layer of the second cover is connected between the first connection side of the second cover and the second shoulder strap, and the second shoulder strap is connected between the auxiliary layer of the second cover and the corresponding back portion; wherein each of the first shoulder strap and the second shoulder strap comprises a strap portion, a first connection element connected between the auxiliary layer and the strap portion, and a second connection element connected between the strap portion and the corresponding back portion, the nursing bra further comprises a third connection element located between the second connection side and the fourth side, the first connection element and the third connection element have a detachable connection.

20. The nursing bra according to claim 19, wherein the first connection element comprises a connection portion connected between the auxiliary layer and the strap portion and a fastener portion disposed on the connection portion, the third connection element comprises a slot corresponding to the fastener portion, the fastener portion is configured to be inserted into the slot so as to connect the first connection element and the third connection element; wherein the back portion comprises a main body connected with one of the first cover and the second cover and a connection end connected with a side of the main body, one of the two connection ends of the back portions comprises at least one hook portion, the other one of the two connection ends of the back portions comprises at least one ring portion corresponding to the hook portion, and the hook portion is configured to hook the ring portion so as to connect the two back portions.

* * * * *